US008646545B1

(12) United States Patent
Elliott

(10) Patent No.: US 8,646,545 B1
(45) Date of Patent: Feb. 11, 2014

(54) POWER PIVOT DEVICE FOR A PLOW

(75) Inventor: Ronald L. Elliott, Oregon City, OR (US)

(73) Assignee: Warn Industries, Inc., Clackamas, OR (US)

( * ) Notice: Subject to any disclaimer, the term of this patent is extended or adjusted under 35 U.S.C. 154(b) by 0 days.

(21) Appl. No.: 13/551,250

(22) Filed: Jul. 17, 2012

(51) Int. Cl.
*E02F 3/76* (2006.01)

(52) U.S. Cl.
USPC ..... 172/819; 474/14; 474/149; 192/223.1

(58) Field of Classification Search
USPC ..... 37/270, 234, 236, 271; 172/819, 793; 475/14, 149; 192/223.1
See application file for complete search history.

(56) References Cited

U.S. PATENT DOCUMENTS

| | | | | |
|---|---|---|---|---|
| RE16,624 | E * | 5/1927 | Gledhill | 172/793 |
| 2,919,588 | A * | 1/1960 | Sundt | 74/76 |
| 3,976,172 | A | 8/1976 | F'Geppert | |
| 4,448,098 | A | 5/1984 | Totsu | |
| 4,721,015 | A * | 1/1988 | Hartmann | 475/277 |
| 6,334,269 | B1 | 1/2002 | Dilks | |
| 6,851,486 | B2 * | 2/2005 | Marshall | 172/792 |
| 6,938,829 | B2 * | 9/2005 | Doherty et al. | 239/1 |
| 7,839,301 | B2 * | 11/2010 | Doherty et al. | 340/905 |
| 7,946,942 | B2 * | 5/2011 | Yoder | 475/14 |
| 8,328,675 | B2 * | 12/2012 | Yoder | 475/14 |
| 2008/0298885 | A1 | 12/2008 | Yoder | |
| 2009/0090032 | A1 * | 4/2009 | Yang et al. | 37/234 |
| 2011/0186314 | A1 * | 8/2011 | Yoder | 172/817 |

* cited by examiner

*Primary Examiner* — Arpád Fábián-Kovács
(74) *Attorney, Agent, or Firm* — Harness, Dickey & Pierce, P.L.C.

(57) ABSTRACT

A plow pivot assembly includes a base adapted to be coupled to a frame member and rotationally fixed relative thereto. A pivot assembly is coupled to the base and includes a motor mounted to a first ring gear, a planetary gear assembly driven by the motor and including a planetary carrier assembly having a plurality of split planetary gears engaging with both the first ring gear and a second ring gear which is fixed to the base for causing rotation of the first ring. A plow blade is attached to the first ring gear by a pivot base that incorporates a force absorbing system therein to protect the planetary gear assembly from damage.

16 Claims, 5 Drawing Sheets

POWER PIVOT DEVICE FOR A PLOW

FIELD

The present disclosure relates to pivot assemblies, and more specifically to power actuated pivot assembly for a plow.

BACKGROUND

This section provides background information related to the present disclosure which is not necessarily prior art.

Plow systems are commonly used for all-terrain vehicles (ATVs). Current plow systems can require the driver to get off of the vehicle to adjust the pivot angle of the plow blade. A variety of other maintenance equipment used in combination with tractors and/or ATVs, such as lawn cutting and sweeper assemblies, can require a user to manually adjust a rotary orientation of the maintenance equipment.

SUMMARY

This section provides a general summary of the disclosure, and is not a comprehensive disclosure of its full scope or all of its features.

A plow pivot assembly includes a base adapted to be coupled to a frame member and rotationally fixed relative thereto. A pivot assembly is mounted to the base and includes a motor mounted to a first ring gear. A planetary gear assembly is driven by the motor and includes a planetary carrier assembly having a plurality of coupled/tandem planetary gears engaging with both the first ring gear and a second ring gear which is rotatable relative to the first ring gear. A plow blade is drivingly attached to a rotary base so as to have its angular position altered by movement of the first ring gear relative to the second ring gear.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
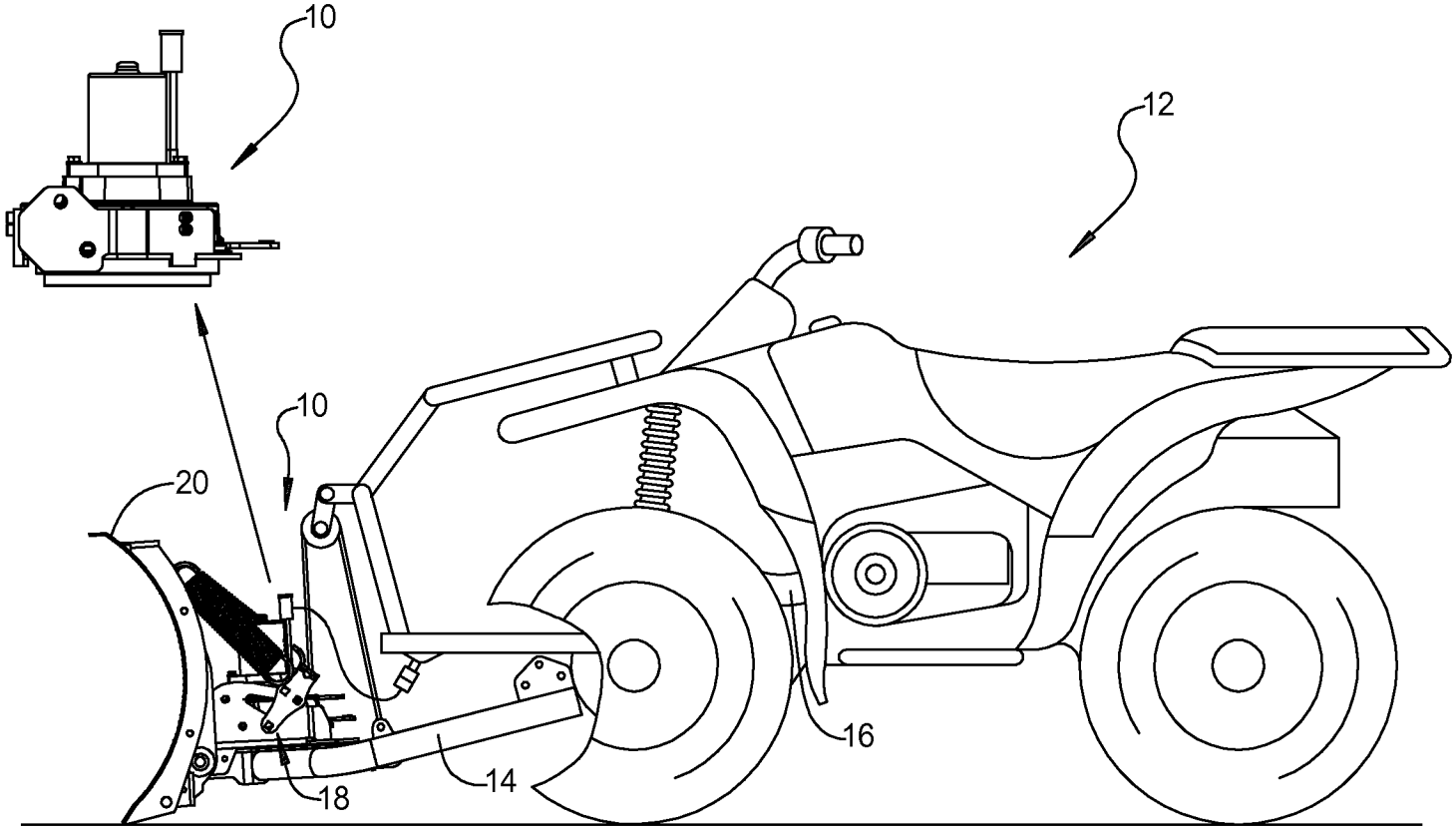
FIG. 1 is a side view of a plow pivot assembly according to the principles of the present disclosure mounted to a vehicle.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a plow assembly 10 may be mounted to a vehicle, such as a utility vehicle 12. A vehicle mounting structure 14 of the plow assembly 10 may be coupled to a frame 16 of vehicle 12. More specifically, vehicle mounting structure 14 may be laterally fixed relative to frame 16 and vertically pivotable for upward and downward displacement of plow mount assembly 10. A plow pivot device 18 may have a plow blade 20 drivingly coupled thereto. Plow blade 20 may rotate during actuation of plow pivot device 18. Plow mount assembly 10 therefore provides powered rotation of plow blade 20.

Figure 2:
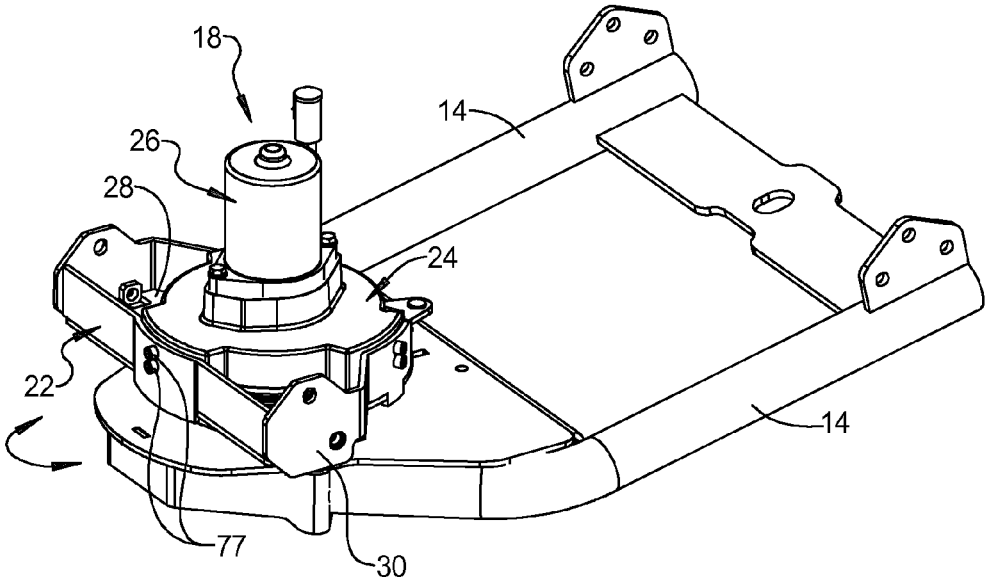
FIG. 2 is a perspective view of the plow pivot assembly according to the present disclosure.
Figure 3:
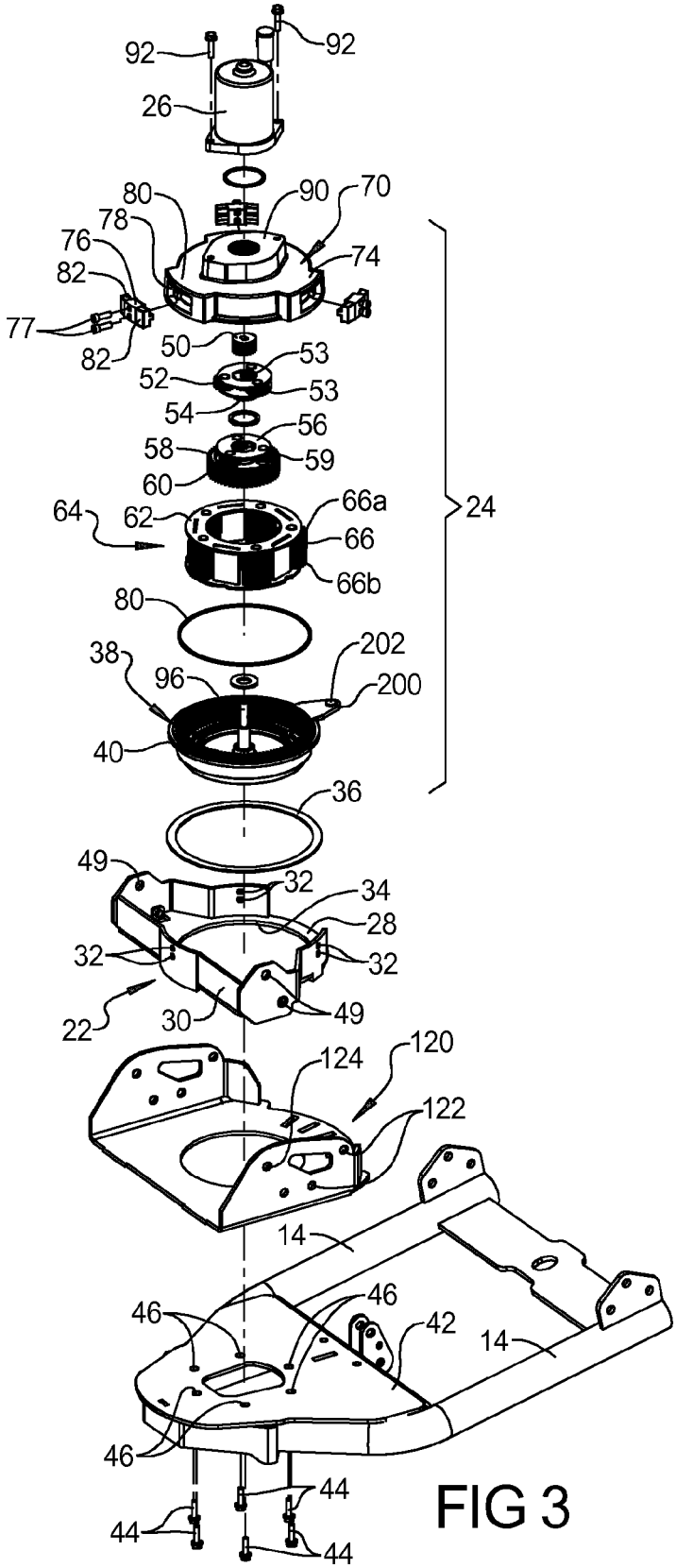
FIG. 3 is a exploded perspective view of a portion of the plow pivot assembly of FIG. 1.
Figure 4:
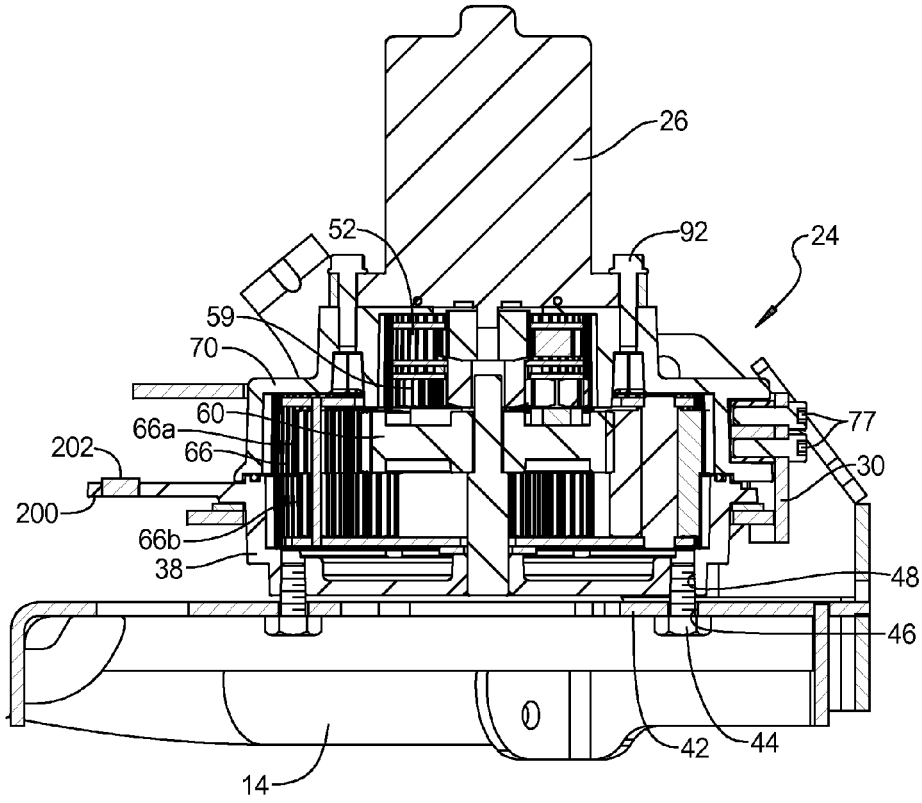
FIG. 4 is a cross-sectional view of the plow pivot assembly according to the principles of the present disclosure.

With reference to FIG. 2, the power pivot device 18 can include a pivot bracket 22 that joins the plow blade 20 to a planetary gear set contained in gear housing 24. With reference to FIG. 3, the pivot bracket 22 can include a base plate 28 and a sidewall structure 30 extending vertically therefrom. The sidewall structure 30 can be provided with a plurality of apertures 32 generally spaced at 120 degree intervals around a large circular aperture 34 provided in the base plate 28. Circular aperture 34 can receive a lower ring gear 38 of the planetary gear set 24 therein. A thrust washer 36 may be placed on an upper surface of base plate 28 to reduce thrust friction. The lower ring gear 38 can include a radially extending flange portion 40 that rests on the thrust washer 36. The lower ring gear 38 can be secured to a fixed base plate 42 of the vehicle mounting structure 14 by fasteners 44 extending through apertures 46 in base plate 42 and threaded into apertures 48 in lower ring gear 38, as best shown in FIG. 4. The sidewall structure 30 of the pivot bracket 22 can further include mounting features 49 for mounting the pivot bracket 22 to the plow blade 20. Alternatively, an optional blade base 120 could be used to allow the pivot device 18 to be used with existing plow assemblies or the pivot bracket 22 and blade base 120 could be one part. The pivot bracket 22 can be attached to the mounting apertures 122 of the blade base 120 while the plow blade 20 can be mounted to the mounting apertures 124.

The planetary gear assembly 24 can be configured as a multiple-stage split-ring planetary gear set and can include a first sun gear 50 that is driven by the motor 26 and provides input to a first planetary carrier 52 of a first stage of the planetary gear system via planetary gears 53. The first planetary carrier 52 can be attached to a second sun gear 54 that provides input to a second planetary carrier 56 of a second stage planetary gear assembly 58 via planetary gears 59. The second planetary carrier 56 of the second stage planetary gear assembly 58 is connected to a third sun gear 60 that provides input to a third carrier assembly 62 of a third stage planetary gear assembly 64 via coupled/tandem planetary gears 66. The coupled/tandem planetary gears 66 include first gear portions 66*a* that engage with an upper ring gear 70 and second gear portions 66*b* that engage with the lower ring gear 38. The number of teeth on the upper ring gear 70 and the lower ring gear 38 are different so as to provide a rotation of the upper ring gear 70 relative to the lower ring gear 38 which is fixed to the base plate 42. By way of non-limiting example, the upper ring gear 70 can have, for example, 90 teeth and the lower ring gear 38 can have 95 teeth to provide a large gear reduction between the motor output and the rotation of the upper ring gear 70. An O-ring seal 80 can be provided between the lower ring gear 38 and fixed ring gear 70 to provide a sealed engagement therebetween.

The profile and shape of the teeth on the planetary gear portions 66*a*, 66*b* can differ so as to provide proper engagement with the fixed ring gear 70 and the lower ring gear 38. The compact arrangement of the multi-stage planetary gear set 24 provides a compact arrangement for providing the gear reduction. In addition, this type of split ring differential planetary gear set also serves as a brake feature in that it is difficult to back drive the gear set so that no secondary braking system is required. The elimination of a braking system can greatly reduce the cost and weight of a pivot device.

The upper ring gear 70 is mounted to the mounting apertures 32 of the pivot base 22 by a shock absorbing system 74 that can include a damper block 76 that is secured to the wall structure 30 of the pivot base 22 via fasteners 77 extending through the mounting features 32. The damper block 76 is received within a compression cavity 78 of a housing 80 that is provided on the upper ring gear 70 and includes a pair of elastomeric bushings 82 disposed on opposite sides of the damper block 76 in order to absorb impact forces that occur in the event that the plow blade 20 hits an obstruction and thereby provides shock absorption to prevent damage to the teeth of the planetary gear system 24. In addition, the damper block 76 fasteners 77 are designed to be of a strength wherein the fasteners 77 would break or shear if an impact force exceeds a predetermined level that would potentially cause damage to the gear teeth. In other words, the fasteners 77 are designed to break prior to transmitting impact forces that would damage the teeth of the planetary gear set 24.

The motor 26 can be mounted to a mount feature 90 that is provided on the upper ring gear 70 and can be secured in place by fasteners 92 which are threadedly received within the mount feature 90. It should be understood that the second sun gear 54 and third sun gear 60 can be rotatably mounted on a spindle 96 which is fixedly supported by the lower ring gear 38. An arm 200 can extend from the lower ring gear 38 for supporting a magnet 202 thereon in order to provide feedback regarding the position of the plow blade, as will be described in further detail herein.

In operation, the motor 26 is activated to provide input to the planetary gear set 24 that provides for speed reduction and torque multiplication for driving the upper ring gear 70 in a rotary direction. The relatively small rotation of the upper ring gear 70 causes pivoting of the pivot base 22 and the plow blade 20 in a desired direction while the magnet 202 provides a feature for electronic controls that may be used to limit plow blade 20 travel. The shock absorbing system 74 allows the plow blade 20 to receive normal impact forces without imparting forces that could do damage to the teeth of the planetary gear system 24. The fasteners 77 are designed to break or shear if the impact forces to the plow blade 20 are of such a magnitude that might cause damage to the planetary gear system 24. It is noted that the replacement of the fasteners 77 is a relatively simple fix, whereas replacement of a planetary gear system would be a relatively complex and expensive fix.

Figure 5:
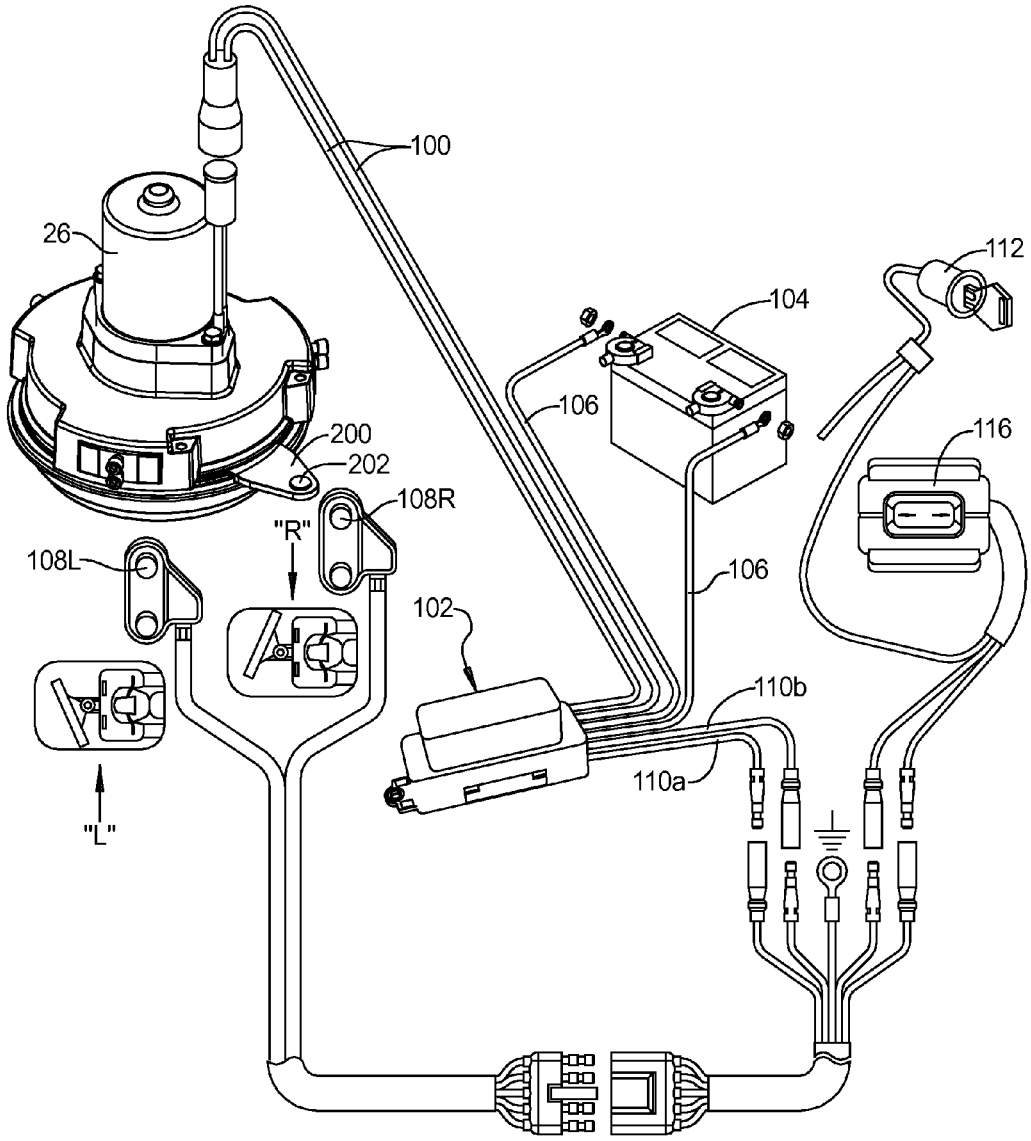
FIG. 5 is a schematic view of the electrical circuitry of the plow pivot assembly according to the present disclosure.

With reference to FIG. 5, the electronic circuit of the power pivot device will now be described. As illustrated, the motor 26 is provided with electric current through cables 100 which are connected to a control unit 102. The control unit 102 is connected to a battery 104 via cables 106 and receives input from position sensors 108L, 108R via cables 110*a*, 110*b*. The system can be activated by connection of a keyed switch 112 that can provide power to switch 116 when vehicle power is active causing the power pivot device to be in an activated state. A pivot switch 116 is provided for allowing the operator to selectively move the pivot device between leftward and rightward angled positions as illustrated by the insets labeled L and R, as illustrated in FIG. 5. As illustrated in the insets L or R, as the magnet arm 200 comes in proximity to the sensors 108L or 108R, the sensors 108L or 108R provide feedback to the control unit 102 to stop the motor 26 before the plow reaches a hard stop position. The sensors 108L, 108R can be mounted to the upper ring gear 70 via a mounting bracket 128, directly to a housing or other movable portion of the plow pivot device so as to move relative to the fixed magnet 202 so that at the two extreme rotatably positions, the sensors 108L, 108R provide feedback to the control unit 102 to stop the motor 26.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A plow pivot assembly comprising:

a base coupled to a frame member;

a pivot assembly mounted to the base and including a motor mounted to a first ring gear, a planetary gear assembly driven by said motor and including a planetary carrier assembly having a plurality of coupled planetary gears engaging with both said first ring gear and a second ring gear which are rotatable relative to one another; and a plow blade and a pivot base are drivingly attached to said first ring gear so as to have their angular position changed by rotation of said first ring gear.

2. The plow pivot assembly of claim 1, wherein said planetary gear assembly is a multiple stage planetary gear assembly.

3. The plow pivot assembly of claim 1, wherein said first ring gear is restrained to rotate relative to said pivot base by an elastomeric bumper.

4. The plow pivot assembly of claim 3, wherein said elastomeric bumper includes at least one block mounted to said pivot base and between a pair of elastomeric bumpers mounted to said first ring gear.

5. The plow pivot assembly of claim 4, wherein said at least one block is mounted to said pivot base by at least one fastener having a strength that is designed to break under an impact force to said plow blade before damage occurs to teeth of said planetary gear assembly.

6. The plow pivot assembly of claim 5, wherein said at least one block includes a plurality of blocks equally spaced around a perimeter of said first ring gear.

7. The plow pivot assembly of claim 5, wherein said at least one block is mounted to said pivot base by a pair of fasteners having a combined strength designed to break under an impact force to said plow blade before damage occurs to teeth of said planetary gear assembly.

8. The plow pivot assembly of claim 1, further comprising a control unit and at least one position sensor for providing feedback to the control unit of the position of the plow blade and stopping the motor.

9. A plow pivot assembly comprising:

a base coupled to a frame member;

a pivot assembly mounted to the base and including a motor drivingly connected to a sun gear of a planetary gear assembly including a planetary carrier assembly having a plurality of coupled planetary gears engaging with both a first ring gear and a second ring gear which are rotatable relative to one another; and a plow blade and a pivot base drivingly attached to said first ring gear so as to have their angular position changed by rotation of said first ring gear.

10. The plow pivot assembly of claim 9, wherein said planetary gear assembly is a multiple stage planetary gear assembly.

11. The plow pivot assembly of claim 9, wherein said first ring gear is restrained to rotate relative to said pivot base by an elastomeric bumper.

12. The plow pivot assembly of claim 11, wherein said elastomeric bumper includes at least one block mounted to said pivot base and between a pair of elastomeric bumpers mounted to said first ring gear.

13. The plow pivot assembly of claim 12, wherein said at least one block is mounted to said pivot base by at least one fastener having a strength that is designed to break under an impact force to said plow blade before damage occurs to teeth of said planetary gear assembly.

14. The plow pivot assembly of claim 13, wherein said at least one block includes a plurality of blocks equally spaced around a perimeter of said first ring gear.

15. The plow pivot assembly of claim 13, wherein said at least one block is mounted to said pivot base by a pair of fasteners having a combined strength designed to break under an impact force to said plow blade before damage occurs to teeth of said planetary gear assembly.

16. The plow pivot assembly of claim 9, further comprising a control unit and at least one position sensor for providing feedback to the control unit of the position of the plow blade and stopping the motor.

* * * * *

UNITED STATES PATENT AND TRADEMARK OFFICE

CERTIFICATE OF CORRECTION

PATENT NO. : 8,646,545 B1
APPLICATION NO. : 13/551250
DATED : February 11, 2014
INVENTOR(S) : Ronald L. Elliott It is certified that error appears in the above-identified patent and that said Letters Patent is hereby corrected as shown below:

In the Specification

At column 4, line number 9, delete “base” and insert --bracket-- therefor.

At column 4, line number 11, delete “base” and insert --bracket-- therefor.

At column 4, line number 12, delete “features” and insert --apertures-- therefor.

At column 4, line number 20, after “76” insert --and-- therefor.

At column 4, line number 40, delete “base” and insert --bracket-- therefor.

Signed and Sealed this
Thirteenth Day of May, 2014

Michelle K. Lee

Michelle K. Lee
*Deputy Director of the United States Patent and Trademark Office*